US009814316B2

(12) United States Patent
Kassanoff et al.

(10) Patent No.: US 9,814,316 B2
(45) **Date of Patent: *Nov. 14, 2017**

(54) CHAIR SYSTEM

(71) Applicant: Paragon Furniture, LP, Arlington, TX (US)

(72) Inventors: Richard Kassanoff, Dallas, TX (US); Robert Larry Stewart, Grapevine, TX (US)

(73) Assignee: Paragon Furniture, Inc., Arlington, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/993,841

(22) Filed: Jan. 12, 2016

(65) Prior Publication Data

US 2016/0120316 A1 May 5, 2016

Related U.S. Application Data

(63) Continuation of application No. 14/069,135, filed on Oct. 31, 2013, now Pat. No. 9,237,809.

(60) Provisional application No. 61/721,981, filed on Nov. 2, 2012.

(51) Int. Cl.

| | |
|---|---|
| ***A47C 3/00*** | (2006.01) |
| ***A47D 1/00*** | (2006.01) |
| ***A47C 7/00*** | (2006.01) |
| ***A47C 3/04*** | (2006.01) |

(52) U.S. Cl.

CPC ..... *A47C 3/00* (2013.01); *A47C 3/04* (2013.01); *A47C 7/002* (2013.01); *A47D 1/00* (2013.01)

(58) Field of Classification Search

CPC ..... A47C 5/06; A47C 3/04

USPC ..... D6/372; 297/239, 451.1, 451.3, 452.19, 297/183.1, 183.6, 183.7, 446.1, 447.3, 297/447.4, 448.2, 449.1, 450.1, 451.7, 297/452.2, 452.39

See application file for complete search history.

(56) References Cited

U.S. PATENT DOCUMENTS

| | | | | | |
|---|---|---|---|---|---|
| 2,141,475 | A | * | 12/1938 | Johannsen | A47C 3/023 297/295 |
| 2,835,317 | A | * | 5/1958 | Valtri | A47C 5/06 248/188 |
| 3,173,723 | A | * | 3/1965 | Hoven | A47C 3/18 297/451.1 |
| 3,291,529 | A | * | 12/1966 | Straits | A47C 3/04 297/183.7 |
| 3,556,591 | A | * | 1/1971 | Smith | A47C 16/02 297/270.5 |

(Continued)

FOREIGN PATENT DOCUMENTS

| | | | | | |
|---|---|---|---|---|---|
| DE | 912393 | C | * | 5/1954 | A47C 3/04 |
| DE | 2218060 | A1 | * | 10/1973 | A47C 3/04 |

(Continued)

*Primary Examiner* — Rodney Mintz

(74) *Attorney, Agent, or Firm* — Ferguson Braswell Fraser Kubasta PC; Elizabeth Philip Dahm; Kelly J. Kubasta

(57) ABSTRACT

A chair system may include a plurality of components that may include a seating surface having seating handles, a backrest having a backrest handle, a kickstand base, and a support frame. The configuration may generally provide a lightweight, comfortable chair system that may be easily adjusted, lifted, transported, arranged and stacked by any user, while still providing substantial structural integrity.

12 Claims, 8 Drawing Sheets

(56) References Cited

U.S. PATENT DOCUMENTS 3,671,074 A * 6/1972 Bergstrom ..... A47C 3/045 297/239
D235,709 S * 7/1975 Schier ..... 297/239
D237,329 S * 10/1975 Vogt ..... D6/372
D249,409 S * 9/1978 Offredi ..... D6/372
4,595,234 A * 6/1986 Kjersem ..... A47C 9/002 297/271.6
4,786,105 A * 11/1988 Sheehan ..... A47C 3/029 297/271.6
6,540,292 B2 * 4/2003 Darling ..... A47D 13/102 297/130
6,957,860 B1 * 10/2005 Leist ..... A47C 3/04 297/239
D514,343 S * 2/2006 Pilcher ..... D6/372
7,380,879 B2 * 6/2008 Fletcher ..... A47C 3/12 16/42 R
7,708,349 B2 * 5/2010 Chen ..... A47C 1/124 297/239
D644,863 S * 9/2011 James ..... D6/707.22
9,237,809 B2 * 1/2016 Kassanoff ..... A47C 3/04
2002/0050728 A1 * 5/2002 Brown ..... A47D 13/102 297/130
2003/0214172 A1 * 11/2003 Bosman ..... A47B 7/02 297/446.2
2008/0258514 A1 * 10/2008 Nichols ..... A47B 9/20 297/135
2011/0084526 A1 * 4/2011 Sneujink ..... A47C 1/124 297/239
2012/0248837 A1 * 10/2012 Peters ..... A47C 3/04 297/239
2014/0125093 A1 * 5/2014 Kassanoff ..... A47C 3/04 297/183.1

FOREIGN PATENT DOCUMENTS

DE EP 1897467 A1 * 3/2008 ..... A47C 3/023
FR 1279402 A * 12/1961 ..... A47C 7/02

* cited by examiner

CHAIR SYSTEM

CROSS REFERENCE TO RELATED APPLICATION

This application is a continuation of U.S. patent application Ser. No. 14/609,135, filed on Oct. 31, 2013, which will issue on Jan. 19, 2016 as U.S. Pat. No. 9,237,809, and which claims the benefit under 35 U.S.C. §119(e) of U.S. Provisional Patent Application Ser. No. 61/721,981 filed on Nov. 2, 2012, entitled "Chair System," all of which are incorporated by reference in their entirety.

FIELD OF THE DISCLOSURE

The present disclosure relates generally to furniture and, in particular, to chairs.

BACKGROUND

Conventional chairs typically used in educational environments are bulky and generally fail to provide adequate leverage for all users, especially younger students, to easily adjust, lift, arrange and stack such units as is often necessary in a classroom. Moreover, conventional chairs generally comprise a back, a base, and a leg supporting each corner of the base.

SUMMARY

Embodiments of the present disclosure generally provide a lightweight, comfortable chair system that may be easily lifted, transported, arranged and stacked by any user, while still providing substantial structural integrity.

Embodiments of the present disclosure generally provide a chair system comprising a plurality of components that may include, but are not limited to, a seating surface having seating handles, a backrest having a backrest handle, a kickstand base, and a support frame.

Embodiments of the present disclosure may provide a chair system including a seating surface, a backrest, a kickstand base, and a support frame having a pair of L-shaped backrest spine members having a standing section and a laying section, and a pair of C-shaped base members having a top portion, a base portion and a vertical section therebetween. The laying section of the L-shaped backrest spine members may couple to the top portion of the C-shaped base members. The seating section may be coupled to the top portion of the C-shaped base members, the backrest may be coupled to the standing section of the L-shaped backrest spine members, and the kickstand base may be coupled between the base portion of the C-shaped base members. The seating surface may include at least one seating handle. The at least one seating handle may be selected from the group including curvatures embedded on a bottom surface of an outer corner of the seating surface, grip handles, pull handles, and strap handles. The backrest may include at least one backrest handle. The at least one backrest handle may be selected from the group including curvatures embedded on a lower surface of the backrest, grip handles, pull handles, and strap handles. The chair system may further include at least one glider coupled to the support frame to allow for easy stackability. The kickstand base may include stoppers to engage the kickstand base with a floor surface. The support frame may include footcaps to engage the support frame with a floor surface.

Embodiments of the present disclosure may include a chair system including a seating surface, a backrest, a kickstand base, and a support frame having a pair of C-shaped base members and a pair of L-shaped backrest spine members. Each C-shaped base member may comprise a seating surface support section, a base section and a vertical section therebetween. Each L-shaped backrest spine member may comprise a backrest support section and a base attachment section. The base attachment section of each L-shaped backrest spine member may fixedly couple to the seating surface support section of a corresponding C-shaped base member.

The backrest may fixedly couple to a portion of each backrest support section. The seating surface may fixedly couple to each seating surface support section. The seating surface may further include at least one seating handle. The at least one seating handle may be selected from the group including curvatures embedded on a bottom surface of an outer corner of the seating surface, grip handles, pull handles, and strap handles. The backrest may include at least one backrest handle. The at least one backrest handle may be selected from the group including curvatures embedded on a lower surface of the backrest, grip handles, pull handles, and strap handles. The chair system may further include at least one glider coupled to the support frame to allow for easy stackability. The kickstand base may include stoppers to engage the kickstand base with a floor surface. The support frame may include footcaps to engage the support frame with a floor surface.

Embodiments of the present disclosure may provide a chair system including a seating surface having at least one seating handle, a backrest having at least one backrest handle, a kickstand base, and a support frame having a pair of L-shaped backrest spine members having a standing section and a laying section, and a pair of C-shaped base members having a top portion, a base portion and a vertical section therebetween. The laying section of the L-shaped backrest spine members may couple to the top portion of the C-shaped base members. The seating section may be coupled to the top portion of the C-shaped base members, the backrest may be coupled to the standing section of the L-shaped backrest spine members, and the kickstand base may be coupled between the base portion of the C-shaped base members. The kickstand base may include stoppers to engage the kickstand base with a floor surface.

Other technical features may be readily apparent to one skilled in the art from the following figures, descriptions and claims.

BRIEF DESCRIPTION OF THE DRAWINGS

For a more complete understanding of this disclosure and its features, reference is now made to the following description, taken in conjunction with the accompanying drawings, in which.

DETAILED DESCRIPTION

Embodiments of the present disclosure generally provide a lightweight, comfortable chair system which may be easily lifted, transported, arranged and stacked but still provides solid structural integrity.

Figure 1:
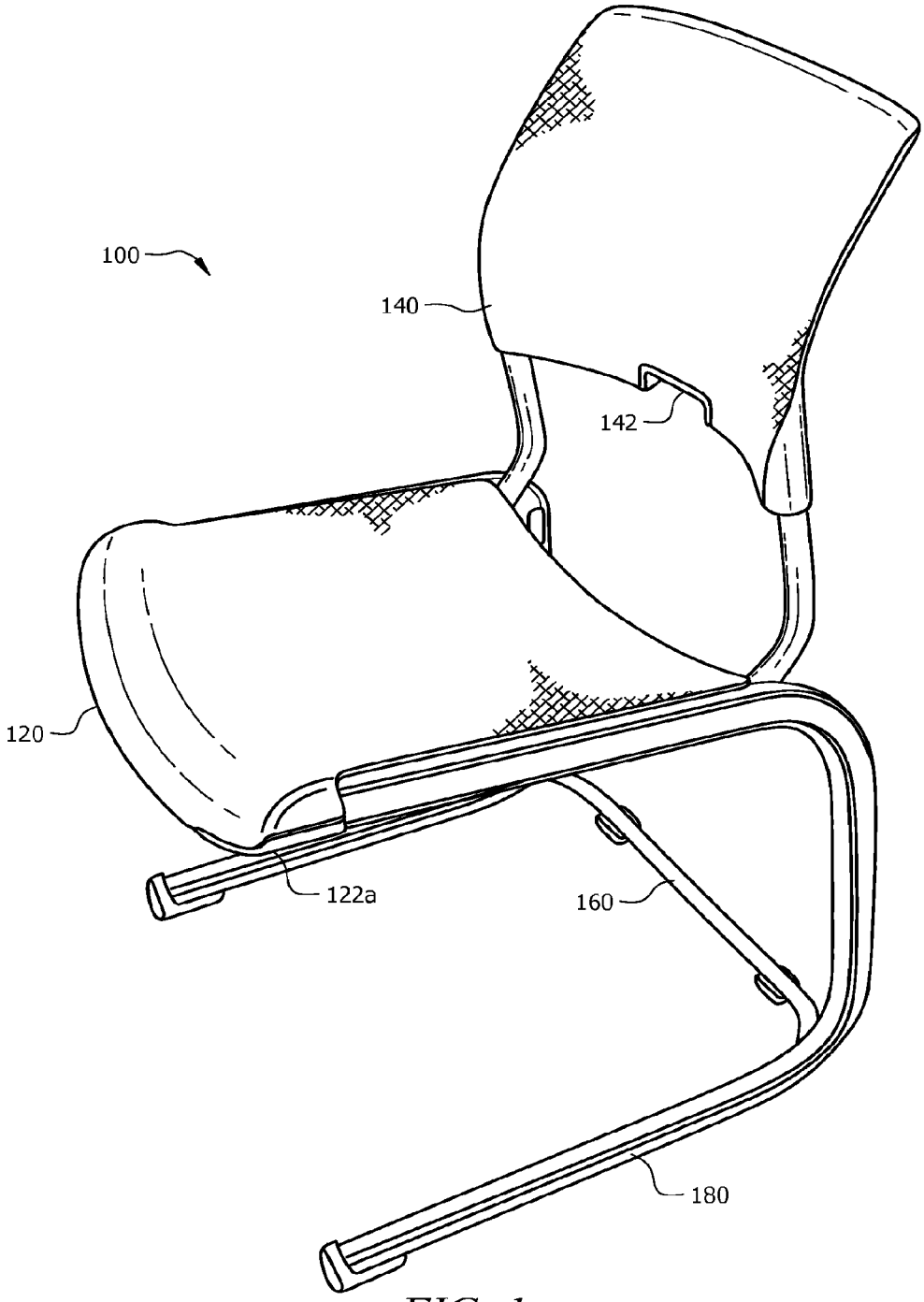
FIGS. 1 and 2 provide perspective views of a chair system according to embodiments of the present disclosure.
Figure 2:
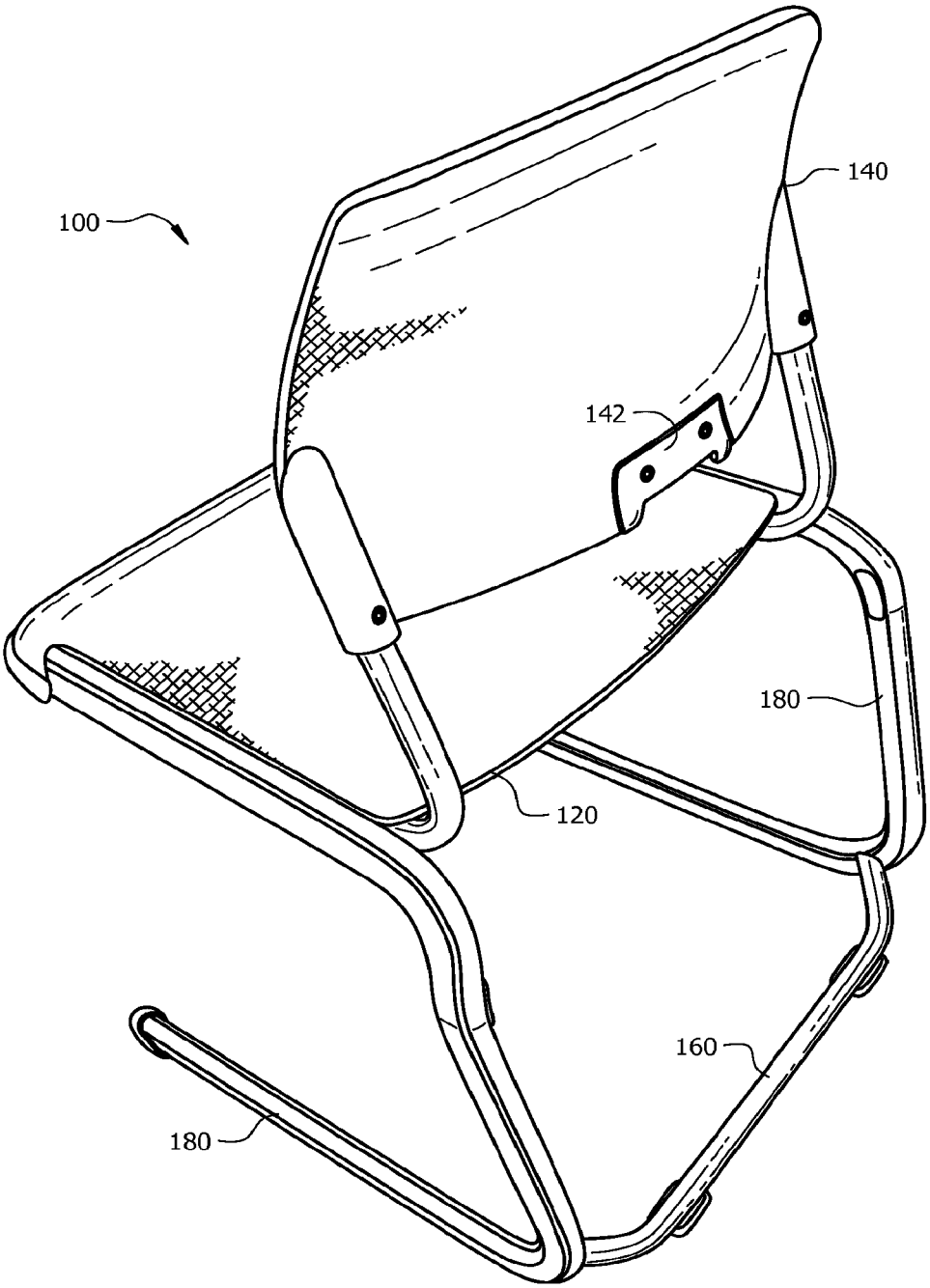

FIGS. 1 and 2 illustrate chair system 100 according to one embodiment of the present disclosure. It should be understood that system 100 shown in FIGS. 1 and 2 is for illustrative purposes only, and any other suitable system or subsystem could be used in conjunction with, or in lieu of, system 100 according to one embodiment of the present disclosure.

Chair systems such as system 100 may be employed for use in conjunction with educational environments, workplace environments, home offices, children's rooms and/or playrooms, other suitable settings, or a combination thereof.

Chair systems may be customized, reconfigured, or adjusted to provide a certain height, size, shape, configuration, position, purpose, utility, decorative look, other suitable disposition, or any combination thereof.

In one embodiment, system 100 may generally comprise seating surface 120, backrest 140, and kickstand base 160, all coupled to support frame 180.

In one embodiment, seating surface 120 may be coupled or otherwise connected to support frame 180 in a generally horizontal orientation and backrest 140 may be coupled or otherwise connected to support frame 180 in a generally perpendicular orientation to seating surface 120, such as to create a seating place for a user.

In embodiments of the present disclosure, seating surface 120 and backrest 140 may comprise any suitably shaped, sized or configured dimensions as desired or required by the user.

Seating surface 120 and backrest 140 may maintain an ergonomic disposition to provide comfort and support to the user while seated.

Seating surface 120 and backrest 140 may also include any suitable surface that provides added comfort to the user, such as, for example, a padded surface, a textured surface, an embellished surface, a layered surface, a soft surface, a pillowy surface, or a combination thereof.

In one embodiment, seating surface 120 may be connected or otherwise coupled to support frame 180 in any suitable manner or method, such as, for example, mounting via male and female coupling adapters, a screw and socket attachment, a nut and bolt attachment, a clip or pin attachment, a ball and socket attachment, or other suitable connection or coupling mechanisms, or any combination thereof.

In one embodiment, backrest 140 may be connected or otherwise coupled to support frame 180 in any suitable manner or method, such as, for example, mounting via male and female coupling adapters, a screw and socket attachment, a nut and bolt attachment, a clip or pin attachment, a ball and socket attachment, or other suitable connection or coupling mechanisms, or any combination thereof.

In one embodiment, backrest 140 may include a backrest handle, such as backrest 142 illustrated in FIGS. 1, 2, 4 and 5 and described in further detail below.

In one embodiment, seating surface 120 may include seating handles, (such as seating handles 122*a* and 122*b* illustrated in FIGS. 3A and 3B) which may be employed to assist the user in moving or adjusting system 100 while seated. Seating handles 122*a* and 122*b* may also be employed to assist the user in lifting, transporting, arranging and stacking system 100 while not seated.

Figure 3A:
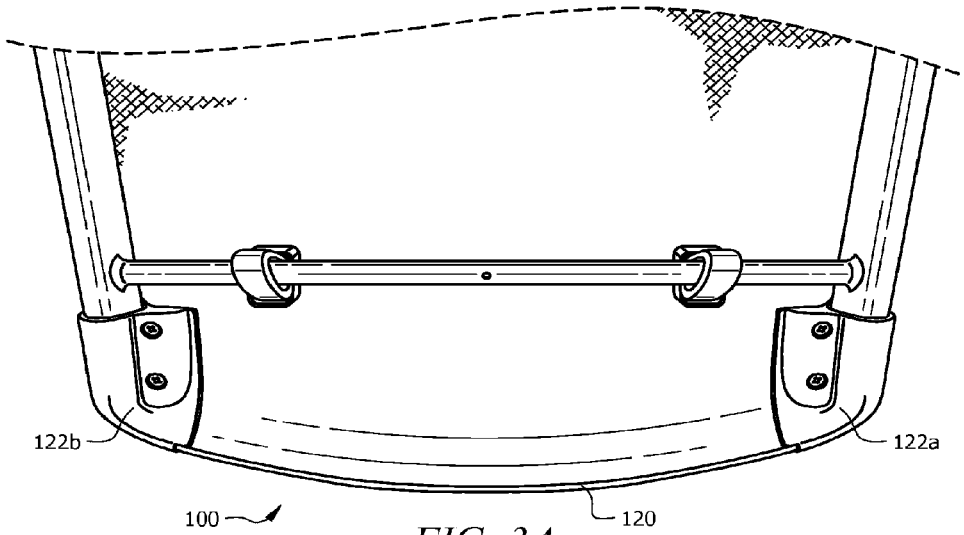
FIG. 3A is a bottom view of a seat surface of the chair system shown in FIG. 2 according to one embodiment of the present disclosure.
Figure 3B:
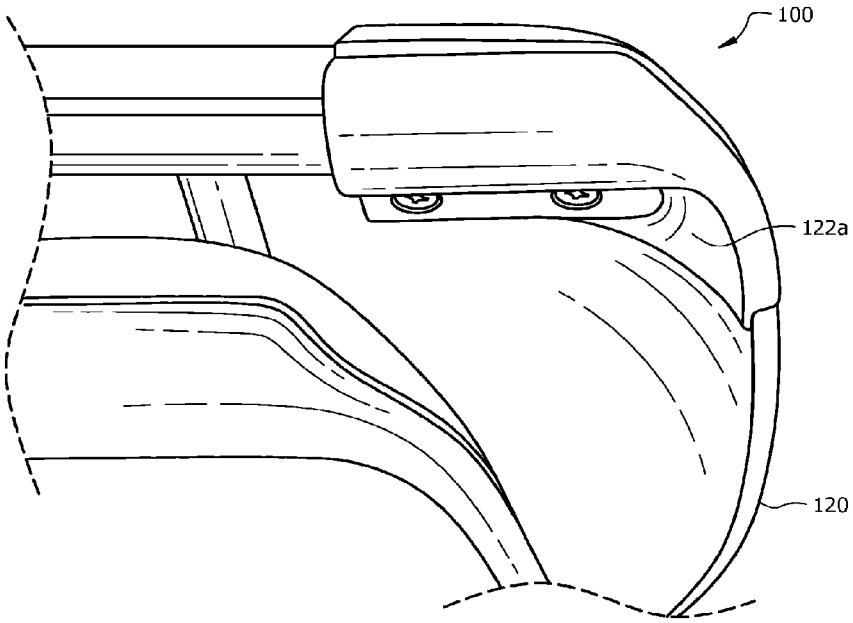
FIG. 3B generally illustrates a seating handle of the seat surface shown in FIG. 3A according to one embodiment of the present disclosure.

Seating handles 122*a* and 122*b* may comprise curvatures on the underside of each outer corner of seating surface 120, as shown in FIGS. 3A and 3B, allowing the user to grasp the corner of seating surface 120 to articulate system 100 in a desired direction.

In other embodiments of the present disclosure, seating handles 122*a* and 122*b* may comprise any other suitably shaped, sized or configured dimensions, such as grip handles, pull handles, strap handles, other suitable lifting mechanisms, or a combination thereof.

Figure 4:
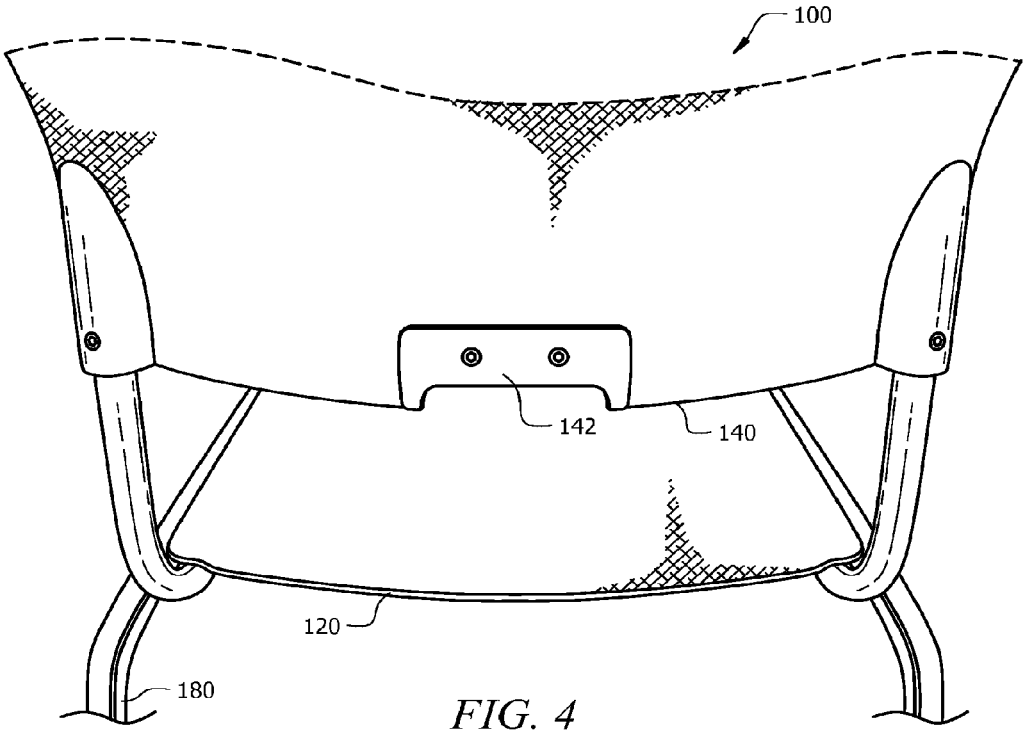
FIG. 4 is a plan view of a backrest handle of the chair system shown in FIG. 2 according to one embodiment of the present disclosure.

FIG. 4 is an exemplary illustration of backrest 140 of system 100 having backrest handle 142 that may be used to further assist the user in lifting, transporting, arranging and stacking system 100 according to one embodiment of the present disclosure.

Backrest handle 142 may comprise curvatures at the bottom of backrest 140 allowing the user to grasp backrest 140 to easily articulate system 100 in a desired direction.

In embodiments of the present disclosure, backrest handle 142 may comprise any other suitably shaped, sized or configured dimensions, such as grip handles, pull handles, strap handles, other suitable lifting mechanisms, or a combination thereof.

In alternative embodiments, backrest handle 142 may be located at any other suitable position engaging backrest 140.

Figure 5:
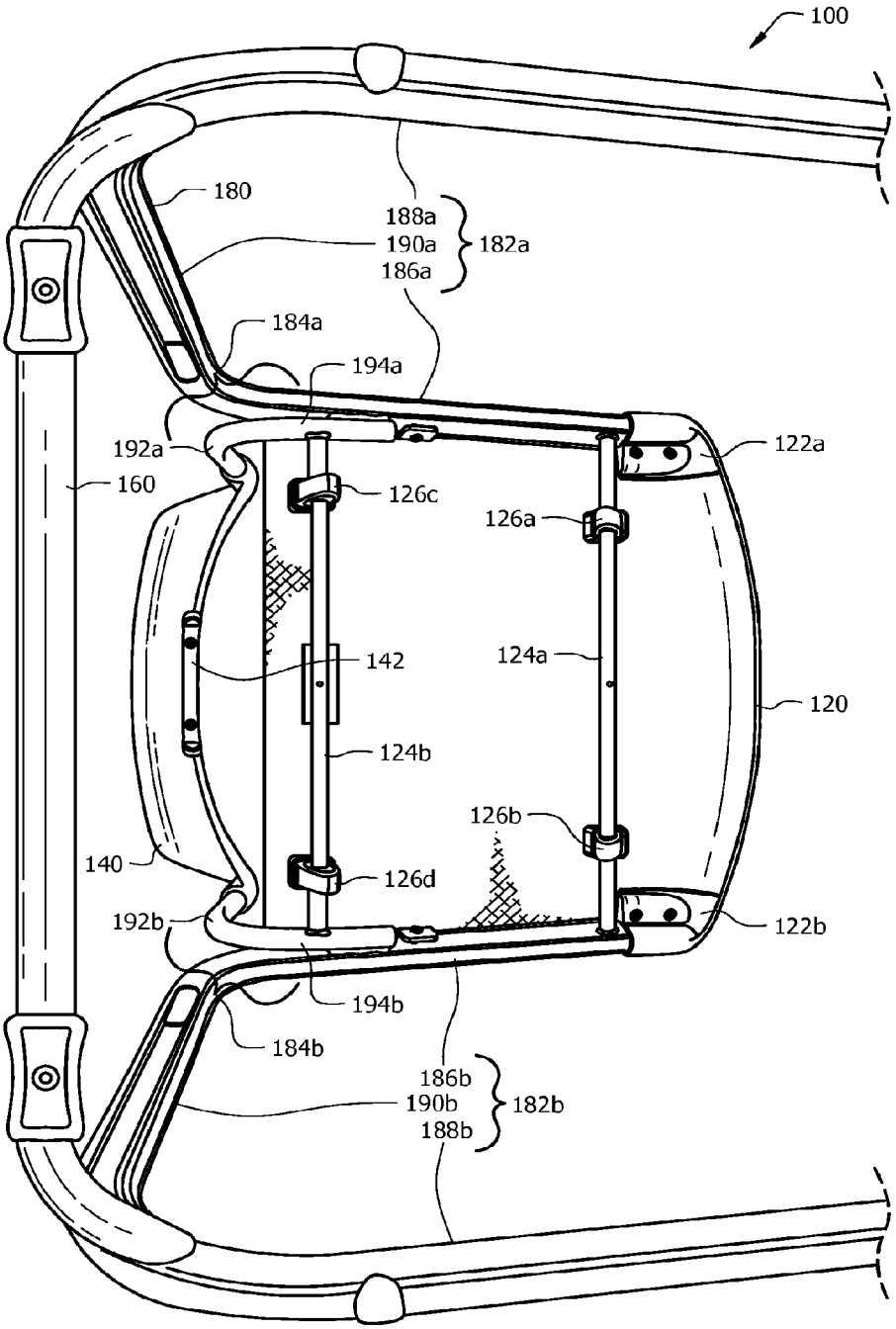
FIG. 5 is a bottom view of the chair system shown in FIG. 2 according to one embodiment of the present disclosure.

FIG. 5 depicts the bottom view of system 100 shown in FIG. 2 illustrating a configuration of support frame 180 according to one embodiment of the present disclosure.

In one embodiment, support frame 180 may generally comprise a pair of C-shaped bases 182*a* and 182*b* and a pair of L-shaped backrest spines 184*a* and 184*b*, as shown in FIG. 5. However, each pair of bases 182 and backrest spines 184 may be oriented in alternative configurations, including C-shaped, L-shaped, U-shaped, V-shaped, O-shaped, D-shaped, or any other suitable shape that can be used to support system 100.

Each base 182*a* and 182*b* includes seating surface support sections 186*a* and 186*b*, respectively, base sections 188*a* and 188*b*, respectively, and vertical sections 190*a* and 190*b* therebetween, respectively. Each backrest spine 184*a* and 184*b* includes backrest support sections 192*a* and 192*b*, respectively, and base attachment sections 194*a* and 194*b*, respectively.

In one embodiment, backrest 140 may be coupled or otherwise connected to a portion of backrest support sections 192*a* and 192*b*, in any suitable manner, such as, for example fixedly sliding backrest 140 onto backrest support sections 192*a* and 192*b* via male and female coupling adapters, a screw and socket attachment, a nut and bolt attachment, a clip or pin attachment, a ball and socket attachment, or other suitable connection or coupling mechanisms, or any combination thereof.

In one embodiment, each base attachment section 194*a* and 194*b* may be coupled or otherwise connected to the inside surface of the corresponding seating surface support sections 186*a* and 186*b*. For example, base attachment section 194*a* may be coupled or otherwise connected to the inside surface of seating surface support section 186*a*, and base attachment section 194*b* may be coupled or otherwise connected to the inside surface of seating surface support section 186*b*, as shown in FIG. 5.

In one embodiment, support frame 180 further comprises seating surface support 124*a*, coupled between bases 182*a* and 182*b*, and seating surface support 124*b*, coupled between backrest spines 184*a* and 184*b*. Seating surface supports 124*a* and 124*b* may be employed to reinforce seating surface 120 to provide a sturdy seating space for the user.

The stacking of system 100 may be typically necessary or desirable to clean the floor, create more space in an area and/or provide a more neat and orderly appearance in a space. In such situations, it is desirable to couple system 100 to other chair units and/or furniture systems such as desk units.

Figure 6:
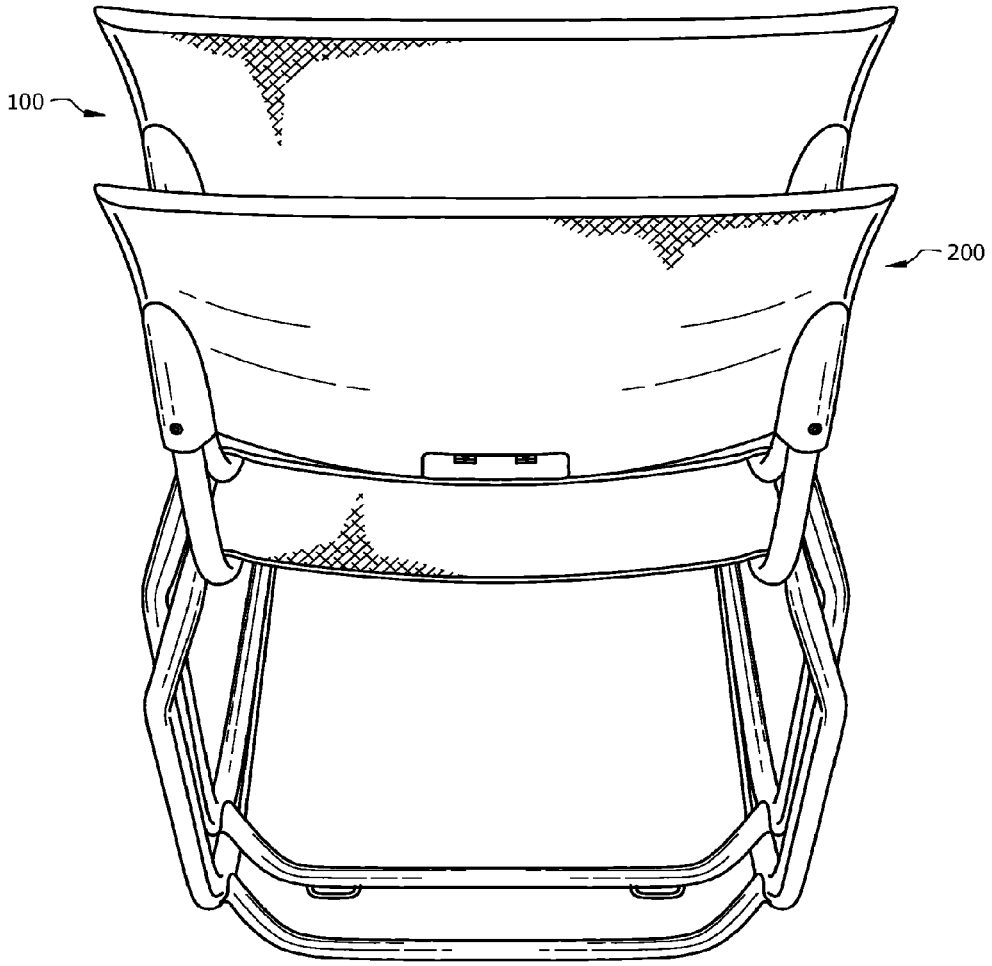
FIG. 6 generally illustrates the chair system of FIG. 2 stacked on top of another chair system according to one embodiment of the present disclosure.
Figure 7:
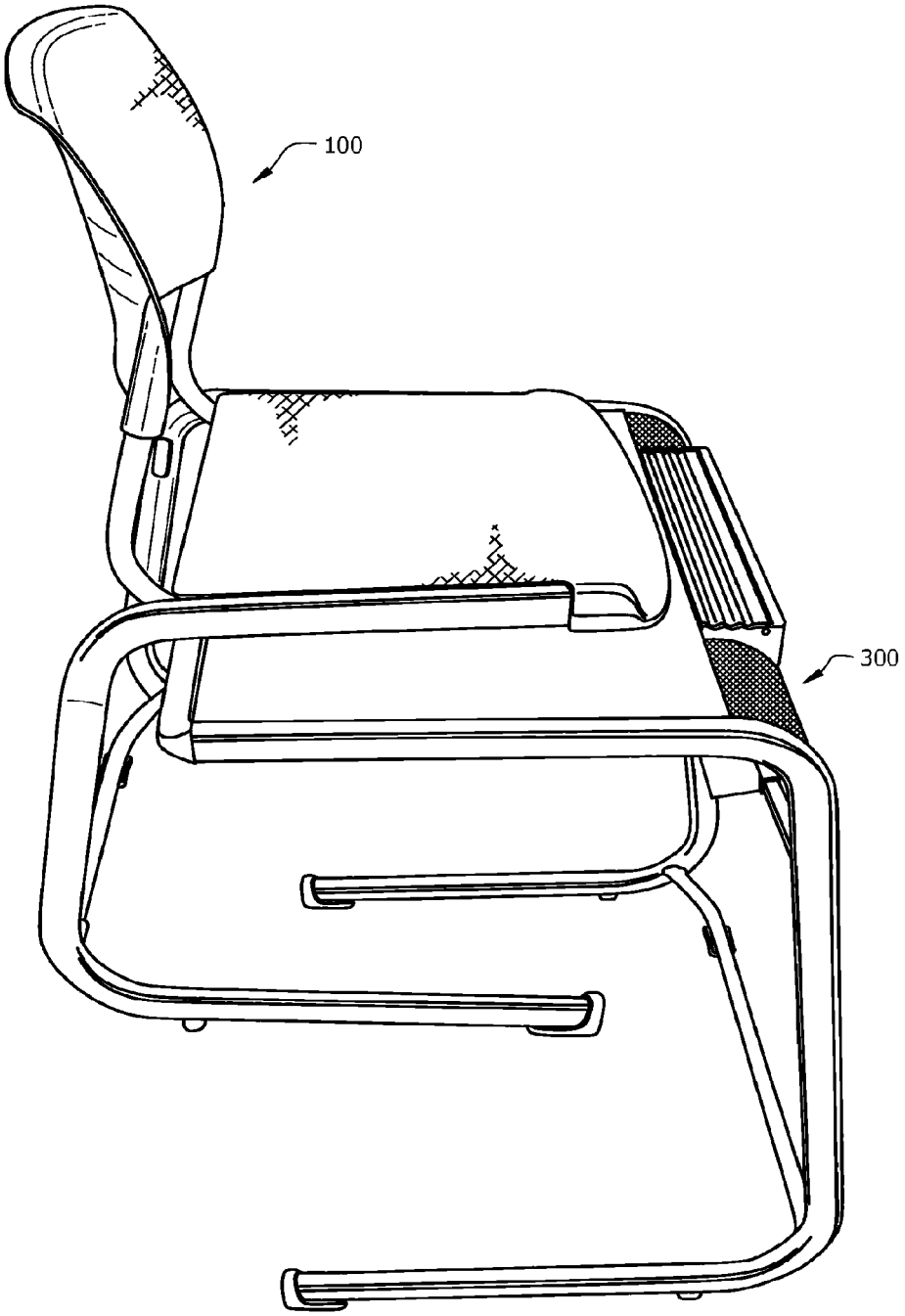
FIG. 7 generally illustrates the chair system of FIG. 2 stacked on top of another furniture system according to one embodiment of the present disclosure.

In one embodiment, seating surface supports 124*a* and 124*b* may include gliders 126*a*, 126*b*, 126*c* and 126*d* (referred to herein as gliders 126). Gliders 126 may be employed to allow the user to easily stack system 100 on top of another chair system 200, as shown in FIG. 6, and furniture systems 300, as shown in FIG. 7, by facilitating the user's ability to slide system 100 on other surfaces.

Gliders 126 also may provide a level of friction so that system 100 will not slide off of other chair units and/or furniture systems without scuffing, scratching or otherwise defacing the other structures.

Figure 8:
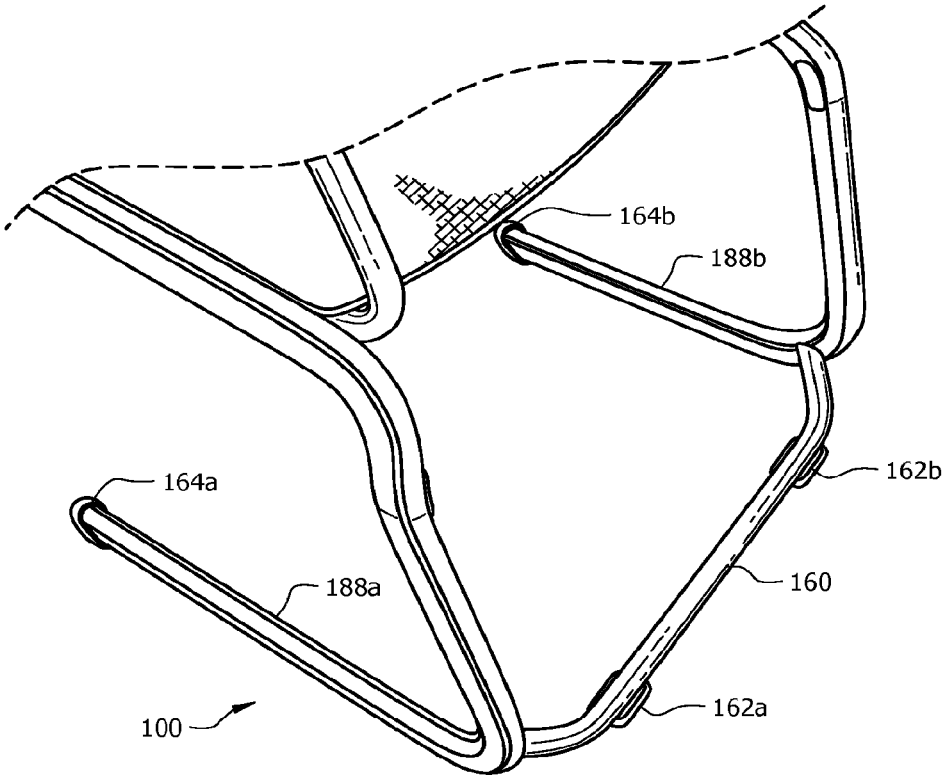
FIG. 8 is a perspective view of a representative kickstand base of the chair system shown in FIG. 2 according to embodiments of the present disclosure.

FIG. 8 illustrates a perspective view of a representative kickstand base 160 of system 100 shown in FIG. 2 according to embodiments of the present disclosure.

Kickstand base 160 may be employed to provide further structural integrity to system 100, thereby substantially preventing users who, intentionally or unintentionally, lean back or forward while sitting in the chair system or rock back and forth while sitting in the chair system, from leaning or rocking too far and tipping over.

In one embodiment of the present disclosure, kickstand base 160 may be coupled or otherwise connected in between base sections 188*a* and 188*b*. The higher connection point between the kickstand base 160 and base sections 188*a* and 188*b* may provide side stability for system 100, while kickstand base 160 may be angled enough to provide sufficient push back when force is exerted against system 100. In one embodiment, the width of kickstand base 160 may be wide enough to extensively engage the floor to create sufficient breadth to effectively prevent system 100 from tipping over.

Kickstand base 160 may also include stoppers 162*a* and 162*b* made of rubber or another resilient material with a high coefficient of friction such that when stoppers 162*a* and 162*b* engage the floor, stoppers 162*a* and 162*b* may further prevent system 100 from tipping over.

Optionally, footcaps 164*a* and 164*b* may be coupled or otherwise connected to base sections 188*a* and 188*b* to further provide stability to the system 100. The large surface area of footcaps 164*a* and 164*b* engage the floor causing friction to effectively prevent system 100 from unintentionally tipping.

In embodiments of the present disclosure, any of seating surface 120, backrest 140, seating handles 122*a* and 122*b*, and/or backrest handle 142 may be made of, composed of or otherwise include, for example, flexible material, plastic, silicon, synthetic rubber, natural rubber, polymer, other solid material, veneer, wood, cork, medium density fiber (MDF) board, particle board, fiberglass, butcher block, glass, steel, stainless steel, aluminum, metal, mesh, apertured material, polypropylene, polyurethane, polyethylene, polyvinyl chloride (PVC), polytetrafluoroethylene (PTFE), polyester, high-gloss polyester, fabric, natural fiber, synthetic fiber, other suitable materials, or any combination thereof.

Any of seating surface supports 124*a* and 124*b*, kickstand base 160, support frame 180, C-shaped bases 182*a* and 182*b*, and L-shaped backrest spines 184*a* and 184*b*, seating surface support section 186, a base section 188, vertical section 190, backrest support section 192, and/or base attachment section 194 may be made of, composed of, or otherwise include, for example, steel, aluminum, brass, bronze, stainless steel, another type of metal, wood, nylon, plastic, polyurethane, polyethylene, polyvinyl chloride (PVC), polytetrafluoroethylene (PTFE), polyester, high-gloss polyester, laminate, plexiglass, polymer, other suitable materials, or any combination thereof.

Any of gliders 126*a*, 126*b*, 126*c* and 126*d*, stoppers 162*a* and 162*b*, and/or footcaps 164*a* and 164*b* may be made of synthetic rubber, natural rubber, plastic, wood, polyester, high-gloss polyester, polymer, metal, steel, aluminum, brass, bronze, nylon, other suitable materials, or any combination thereof.

In one embodiment, seating surface 120, seating handles 122*a* and 122*b*, seating surface supports 124*a* and 124*b*, gliders 126*a*, 126*b*, 126*c* and 126*d*, backrest 140, backrest handle 142, kickstand base 160, stoppers 162*a* and 162*b*, footcaps 164*a* and 164*b*, support frame 180, C-shaped bases 182*a* and 182*b*, and L-shaped backrest spines 184*a* and 184*b*, seating surface support section 186, a base section 188, vertical section 190, backrest support section 192, and/or base attachment section 194 may include any number of suitable coatings and layers to substantially reduce scratching or injury users, as well as to any surface engaged by system 100.

In one embodiment, the coatings and layers applied to seating surface 120, seating handles 122*a* and 122*b*, seating surface supports 124*a* and 124*b*, gliders 126*a*, 126*b*, 126*c* and 126*d*, backrest 140, backrest handle 142, kickstand base 160, stoppers 162*a* and 162*b*, footcaps 164*a* and 164*b*, support frame 180, C-shaped bases 182*a* and 182*b*, and L-shaped backrest spines 184*a* and 184*b*, seating surface support section 186, a base section 188, vertical section 190, backrest support section 192, and/or base attachment section 194 may be made of natural rubber, synthetic rubber, polymer, natural fiber, synthetic fiber, polyester, nylon, cotton, cotton mesh, vinyl, other suitable material, or any combination thereof.

In one embodiment, the coatings and layers applied to seating surface 120, seating handles 122*a* and 122*b*, seating surface supports 124*a* and 124*b*, gliders 126*a*, 126*b*, 126*c* and 126*d*, backrest 140, backrest handle 142, kickstand base 160, stoppers 162*a* and 162*b*, footcaps 164*a* and 164*b*, support frame 180, C-shaped bases 182*a* and 182*b*, and L-shaped backrest spines 184*a* and 184*b*, seating surface support section 186, a base section 188, vertical section 190, backrest support section 192, and/or base attachment section 194 may be embellished with different colors, patterns, camouflage patterns, wood grain patterns, novelty items, ornamental items, stickers, removable stickers, paints, stencils, chalks, designs, images, other decorative materials, or any combination thereof to enhance or otherwise achieve the desired décor of the surroundings.

It may be advantageous to set forth definitions of certain words and phrases used in this patent document. The term "couple" and its derivatives refer to any direct or indirect communication between two or more elements, whether or not those elements are in physical contact with one another. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A chair system comprising:

a first side;

an opposing second side;

a support frame, wherein the support frame comprises:

a pair of C-shaped base members, wherein each of the C-shaped base members comprises:

a seating surface support, wherein a seating surface is coupleable to the seating surface support;

a base section comprising a first end and a second opposing end, wherein at least a portion of the base section is configured to contact a surface on which the chair system is disposed; and a vertical section coupling the seating surface support and the second end of the base section, and wherein the vertical section is proximate the second side of a chair;

wherein a gap is disposed between the first ends of the base sections of the C-shaped base members; and a kickstand coupling the pair of C-shaped base members together proximate the second opposing end of the base section, and wherein the kickstand is disposed proximate the second side of the chair, and wherein at least a portion of the kickstand is configured to contact the surface on which the chair system is disposed, and wherein the kickstand comprises two ends, and wherein each end is coupled to one of the vertical sections of one of the C-shaped base members proximate a connection between the second opposing end of one of the base sections and an end of one of the vertical sections of the C-shaped base members.

2. The chair system of claim 1 further comprises one or more footcaps, wherein a footcap is coupled to the base section and is adapted to contact a floor surface.

3. The chair system of claim 1 further comprising one or more of the seating surface supports.

4. The chair system of claim 1 further comprising one or more of the seating surface supports, wherein at least one of the seating surface supports comprises one or more gliders adapted to inhibit the support frame from sliding off a stack when the support frame is stacked on at least one of another chair or furniture.

5. The chair system of claim 1 further comprising the seating surface coupled to each of the seating surface supports of the pair of C-shaped base members.

6. The chair system of claim 1 further comprising the seating surface, wherein the seating surface comprises at least one seating handle.

7. The chair system of claim 1 further comprising the seating surface, and wherein the seating surface comprises one or more seating handles, and wherein one or more of the seating handles comprises one or more curvatures embedded on a bottom surface of an outer corner of the seating surface.

8. The chair system of claim 1 further comprising two or more of the seating surface supports, wherein at least one of the seating surface supports comprises one or more gliders adapted to inhibit the support frame from sliding off a stack when the support frame is stacked on at least one of another chair or furniture.

9. The chair system of claim 1 further comprising a backrest proximate the second side.

10. The chair system of claim 9 further comprising a pair of L-shaped backrest spine members, wherein each of the L-shaped backrest spine members comprises:

a backrest support section, wherein the backrest is coupled to the backrest support section; and a base attachment section; and wherein each of the base attachment sections of the L-shaped backrest spine members couples to one of the seating surface supports of the C-shaped base members.

11. The chair system of claim 1 further comprising a backrest proximate the second side, and wherein the backrest comprises at least one backrest handle.

12. The chair system of claim 11 further comprising:

a pair of L-shaped backrest spine members, wherein each of the L-shaped backrest spine members comprises:

a backrest support section, wherein the backrest is coupled to the backrest support section; and a base attachment section; and wherein each of the base attachment sections of the L-shaped backrest spine members couples to one of the seating surface supports of the C-shaped base members; and one or more of the seating surface supports disposed between the base attachment sections of the L-shaped backrest spine members, and wherein each seating surface support is disposed between the seating surface supports of the C-shaped base members.

* * * * *